US008489004B2

(12) United States Patent
Mizumoto et al.

(10) Patent No.: US 8,489,004 B2
(45) Date of Patent: Jul. 16, 2013

(54) DEVELOPER DEVICE AND IMAGE FORMING APPARATUS

(75) Inventors: Nofumi Mizumoto, Nara (JP); Takeshi Maeyama, Ikeda (JP); Junya Hirayama, Takarazuka (JP); Shigeo Uetake, Takatsuki (JP); Makiko Watanabe, Uji (JP); Toshiya Natsuhara, Takarazuka (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/701,899

(22) PCT Filed: May 23, 2011

(86) PCT No.: PCT/JP2011/061764

§ 371 (c)(1),
(2), (4) Date: Dec. 4, 2012

(87) PCT Pub. No.: WO2011/155313

PCT Pub. Date: Dec. 15, 2011

(65) Prior Publication Data

US 2013/0078008 A1 Mar. 28, 2013

(30) Foreign Application Priority Data

Jun. 7, 2010 (JP) ..... 2010-130116

(51) Int. Cl.
*G03G 15/08* (2006.01)

(52) U.S. Cl.
USPC ..... 399/285

(58) Field of Classification Search
USPC ..... 399/285, 55, 240, 270
See application file for complete search history.

(56) References Cited

U.S. PATENT DOCUMENTS 4,833,500 A * 5/1989 Mochizuki et al. ..... 399/55
5,911,098 A * 6/1999 Gyotoku et al. ..... 399/264

(Continued)

FOREIGN PATENT DOCUMENTS

JP 6-348117 12/1994
JP 10-26879 1/1998

(Continued)

OTHER PUBLICATIONS

*International Search Report issued on Jun. 21, 2011, by the Japanese Patent Office for International Appl. No. PCT/JP2011/061764.

(Continued)

*Primary Examiner* — Walter L Lindsay, Jr.
*Assistant Examiner* — Rodney Bonnette
(74) *Attorney, Agent, or Firm* — Buchanan Ingersoll & Rooney PC

(57) ABSTRACT

A developer device includes two developer rollers arranged opposite to an image carrier. A first developer bias voltage (waveform Z) of a rectangular waveform obtained by superimposing an AC voltage on a DC voltage is applied to one of the developer rollers. A second developer bias voltage (waveform A) obtained by superimposing an AC voltage on a DC voltage is applied to the other developer roller. The waveform A is a waveform obtained by deforming the rectangular wave in the first developer bias voltage such that toner adhered to the image carrier is prevented from being dislodged by toner being subsequently scattered. According to the developer device, an optimal image density can be obtained at a low-density potential.

5 Claims, 7 Drawing Sheets

U.S. PATENT DOCUMENTS

| | | | | |
|---|---|---|---|---|
| 6,134,414 | A | 10/2000 | Fujita | |
| 7,639,970 | B2 * | 12/2009 | Burry et al. | 399/236 |
| 2006/0008300 | A1 | 1/2006 | Tanaka | |
| 2010/0086323 | A1 * | 4/2010 | Saito et al. | 399/55 |
| 2011/0058836 | A1 * | 3/2011 | Imura et al. | 399/55 |
| 2011/0299893 | A1 * | 12/2011 | Takai et al. | 399/285 |

FOREIGN PATENT DOCUMENTS

| | | |
|---|---|---|
| JP | 2000-56547 | 2/2000 |
| JP | 2004-29569 | 1/2004 |
| JP | 2005-309265 | 11/2005 |
| JP | 2006-23513 | 1/2006 |
| JP | 2009-168893 | 7/2009 |
| JP | 2010-72468 | 4/2010 |

OTHER PUBLICATIONS

*Written Opinion issued on Jun. 21, 2011, by the Japanese Patent Office for International Appl. No. PCT/JP2011/061764.

* cited by examiner

FIG.8

| | COMBINATIONS OF WAVEFORMS | | DEVELOPMENT SYSTEM | RESULTS OF EVALUATIONS | |
|---|---|---|---|---|---|
| | DEVELOPER BIAS FOR DEVELOPER ROLLER 20A | DEVELOPER BIAS FOR DEVELOPER ROLLER 20B | | IMAGE DENSITY AT LOW CONTRAST POTENTIAL | IMAGE STABILITY WITH RESPECT TO Ds VARIATION |
| COMPARATIVE EXAMPLE 1 | Z(RECTANGULAR WAVE) | Z(RECTANGULAR WAVE) | SINGLE COMPONENT DEVELOPMENT SYSTEM | X | Y |
| COMPARATIVE EXAMPLE 2 | A | A | | Y | X |
| COMPARATIVE EXAMPLE 3 | B | B | | X | X |
| COMPARATIVE EXAMPLE 4 | C | C | | Y | X |
| COMPARATIVE EXAMPLE 5 | D | D | | Y | X |
| COMPARATIVE EXAMPLE 6 | B | Z(RECTANGULAR WAVE) | | X | Y |
| COMPARATIVE EXAMPLE 7 | Z(RECTANGULAR WAVE) | B | | X | Y |
| EXAMPLE 1 | A | Z(RECTANGULAR WAVE) | | Y | Y |
| EXAMPLE 2 | Z(RECTANGULAR WAVE) | A | | | |
| EXAMPLE 3 | C | Z(RECTANGULAR WAVE) | | | |
| EXAMPLE 4 | Z(RECTANGULAR WAVE) | C | | | |
| EXAMPLE 5 | D | Z(RECTANGULAR WAVE) | | | |
| EXAMPLE 6 | Z(RECTANGULAR WAVE) | D | | | |

FIG.10

| | COMBINATIONS OF WAVEFORMS | | DEVELOPMENT SYSTEM | RESULTS OF EVALUATIONS | |
|---|---|---|---|---|---|
| | DEVELOPER BIAS FOR DEVELOPER ROLLER 20A | DEVELOPER BIAS FOR DEVELOPER ROLLER 20B | | IMAGE DENSITY AT LOW CONTRAST POTENTIAL | IMAGE STABILITY WITH RESPECT TO Ds VARIATION |
| COMPARATIVE EXAMPLE 1A | A | A | HBD DEVELOPMENT SYSTEM | Y | X |
| COMPARATIVE EXAMPLE 2A | C | C | | Y | X |
| COMPARATIVE EXAMPLE 3A | D | D | | Y | X |
| EXAMPLE 1A | A | Z(RECTANGULAR WAVE) | | Y | Y |
| EXAMPLE 2A | Z(RECTANGULAR WAVE) | A | | | |
| EXAMPLE 3A | C | Z(RECTANGULAR WAVE) | | | |
| EXAMPLE 4A | Z(RECTANGULAR WAVE) | C | | | |
| EXAMPLE 5A | D | Z(RECTANGULAR WAVE) | | | |
| EXAMPLE 6A | Z(RECTANGULAR WAVE) | D | | | |

DEVELOPER DEVICE AND IMAGE FORMING APPARATUS

This application is based on Japanese Patent Application No. 2010-130116 filed with the Japan Patent Office on Jun. 7, 2010, the entire content of which is hereby incorporated by reference.

TECHNICAL FIELD

The present invention relates to an image forming apparatus through use of an electrophotographic system, such as a copying machine, a printer or a facsimile and a developer device used for developing an electrostatic latent image formed on an image carrier in the image forming apparatus.

BACKGROUND ART

Common image forming apparatus and developer device units are disclosed in, for example, Japanese Laid-Open Patent Publication No. 6-348117 (PTL 1), Japanese Laid-Open Patent Publication No. 2000-56547 (PTL 2), Japanese Laid-Open Patent Publication No. 2005-309265 (PTL 3), and Japanese Laid-Open Patent Publication No. 2009-168893 (PTL 4). These pieces of literature each disclose a single component development system, a dual component development system and a hybrid development system (hereinafter may be called an HBD development system) as development systems for visualizing (developing) an electrostatic latent image on a photoconductor.

In the dual component development system, toner and a carrier are used for a dual component developer. Stable charge is quickly given to toner by contact and friction with the carrier. In the dual component development system, the carrier is more likely to be scattered and adhered to the photoconductor as the system speed increases, so that image noise called carrier fogging is more likely to occur.

In the single component development system, only toner is used as a single component developer. Since no carrier exists in a developing portion, carrier fogging does not occur.

The HBD development system has a structure in which the single component development system and the dual component development system are combined together. First, in a section where toner is supplied and transported to a developer roller, supply toner is mixed with a carrier and stirred. Stable charge is quickly given to the toner. It is therefore advantageous in that less stress is imposed on the toner than in the single component development system in which charging is performed in a regulating portion. Furthermore, in the HBD development system, development is performed by forming a toner layer on a developer roller through use of an electric field. Therefore, carrier fogging does not occur even when the system speed increases since no carrier exists in the developing portion.

Japanese Laid-Open Patent Publication No. 2010-72468 (PTL 5) discloses an image forming apparatus in which two developer rollers are arranged opposite to one photoconductor (image carrier). When the single component development system or the HBD development system is adopted in this image forming apparatus, single component development with toner alone is carried out in a developing portion (a region between the surface of an image carrier on which an electrostatic charge image is formed and the developer rollers). By carrying out the single component development, carrier fogging, which is a disadvantage of the dual component development system, is prevented from occurring.

Moreover, the image forming apparatus in which two developer rollers are arranged opposite to one photoconductor can ensure a longer developing zone than in an image forming apparatus in which one developer roller is arranged opposite to one photoconductor. Even when the system speed of the image forming apparatus increases (e.g., in high-speed printing), a sufficient amount of toner can be transported to the photoconductor since the photoconductor and the developer rollers are opposed for a longer time.

CITATION LIST

Patent Literature

PTL 1: Japanese Laid-Open Patent Publication No. 6-348117
PTL 2: Japanese Laid-Open Patent Publication No. 2000-56547
PTL 3: Japanese Laid-Open Patent Publication No, 2005-309265
PTL 4: Japanese Laid-Open Patent Publication No. 2009-168893
PTL 5: Japanese Laid-Open Patent Publication No. 2010-72468

SUMMARY OF INVENTION

Technical Problem

However, when the single component development system or the HBD development system is adopted in the image forming apparatus in which two developer rollers are arranged opposite to one photoconductor, the following problems arise.

When the potential of an electrostatic latent image on a photoconductor is a low-density potential (a potential at which a low-density image is formed), toner is less likely to be developed (conveyed) onto the electrostatic latent image, causing the image density to fall below a desired value.

The present invention was made in view of the foregoing, and has an object to provide a developer device and an image forming apparatus in which two developer rollers are arranged opposite to one photoconductor, wherein an optimal image density can be obtained even at a low-density potential.

Solution to Problem

A developer device based on a first aspect of the present invention is a developer device for developing an electrostatic latent image formed on an image carrier by toner, including a first developer carrier arranged opposite to the image carrier, a second developer carrier arranged opposite to the image carrier and located downstream from the first developer carrier in a moving direction of the image carrier, a first voltage applying unit for applying a first developer bias voltage of a rectangular wave obtained by superimposing an AC voltage on a DC voltage to one of the first developer carrier and the second developer carrier, and a second voltage applying unit for applying a second developer bias voltage obtained by superimposing an AC voltage on a DC voltage to the other of the first developer carrier and the second developer carrier. The AC voltage in the second developer bias voltage has a waveform obtained by deforming the rectangular wave such that toner adhered to the image carrier is prevented from being dislodged by toner being subsequently scattered.

The developer device based on a second aspect of the present invention, in the developer device based on the above-described first aspect, the waveform of the AC voltage in the second developer bias voltage has a development-side peak section in which the toner is supplied from one of the first developer carrier and the second developer carrier to the image carrier, a recovery-side peak section in which the toner is returned from the image carrier to one of the first developer carrier and the second developer carrier, and a voltage changing section which is a transition from the development-side peak section to the recovery-side peak section. The waveform in the voltage changing section is inclined toward the recovery-side peak section starting from a termination of the development-side peak section.

The developer device based on a third aspect of the present invention, in the developer device based on the above-described first aspect, the waveform of the AC voltage in the second developer bias voltage has a development-side peak section in which the toner is supplied from one of the first developer carrier and the second developer carrier to the image carrier, a recovery-side peak section in which the toner is returned from the image carrier to one of the first developer carrier and the second developer carrier, and a voltage changing section which is a transition from the development-side peak section to the recovery-side peak section. The waveform in the voltage changing section has a blank pulse time having a potential difference of 0.

The developer device based on a fourth aspect of the present invention, in the developer device based on the above-described third aspect, the blank pulse time is more than or equal to about 0.02 ms and less than or equal to about 0.06 ms.

The developer device based on a fifth aspect of the present invention, in the developer device based on any of the above-described first to fourth aspects, includes a transport member arranged opposite to the first developer carrier and the second developer carrier and carrying a developer containing the toner and a carrier and supplying the toner in the developer to the first developer carrier and the second developer carrier.

An image forming apparatus based on the present invention includes the image carrier, an image forming mechanism for forming an electrostatic latent image on the image carrier, and the developer device based on any of the above-described first to fourth aspects.

Advantageous Effects of Invention

According to the present invention, it is possible to obtain a developer device and an image forming apparatus in which two developer rollers are arranged opposite to one photoconductor, wherein an optimal image density can be obtained even at a low-density potential.

BRIEF DESCRIPTION OF DRAWINGS

FIG. 8 is a third diagram showing the results of measurements of experimental examples performed using the developer device according to the first embodiment.

FIG. 10 is a diagram showing the results of measurements of experimental examples performed using the developer device according to the second embodiment.

DESCRIPTION OF EMBODIMENTS

A developer device and an image forming apparatus according to each embodiment based on the present invention will be described below with reference to the drawings. When the number, an amount or the like is mentioned in the embodiments described below, the scope of the present invention is not necessarily limited to that number, that amount or the like, unless otherwise specified. The same parts and corresponding parts are denoted by the same reference numbers, and repeated description may not be provided.

First Embodiment

Single Component Development System

Image Forming Apparatus 1000

Figure 1:
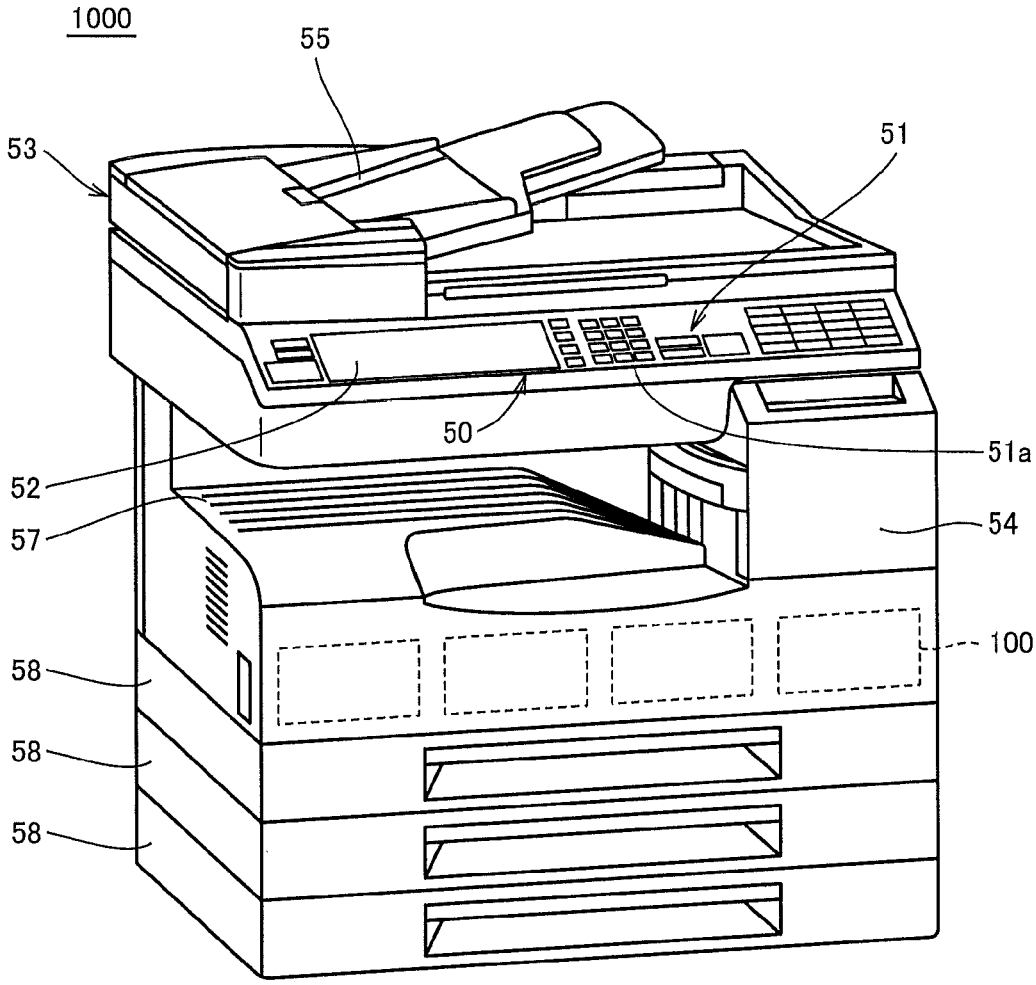
FIG. 1 is a perspective view showing an appearance of an image forming apparatus according to first and second embodiments.

Referring to FIG. 1, an image forming apparatus 1000 according to the present embodiment will be described. Image forming apparatus 1000 is an example of an image forming apparatus, such as a copying machine, a printer or a facsimile. Image forming apparatus 1000 has a control unit 51 and an operation display 52 in an operation panel 50 located on the upper part of a main body. Control unit 51 receives various types of user's instructions, for example, input by means of keys 51*a*. Operation display 52 displays an instruction menu to the user, for example.

A scanner 53 and a feeder 55 are provided on the upper surface of the main body. Feeder 55 sends a document to scanner 53. A printer 54 is provided on a side part of the main body. A tray 57 and a paper feed unit 58 are provided at the lower part of the main body. A recording sheet with an image printed thereon by printer 54 is discharged to tray 57. Paper feed unit 58 supplies a recording sheet to printer 54. An image forming unit 100 is provided inside the main body. Image forming unit 100 prints an image on a recording sheet.

Image Forming Unit 100

Figure 2:
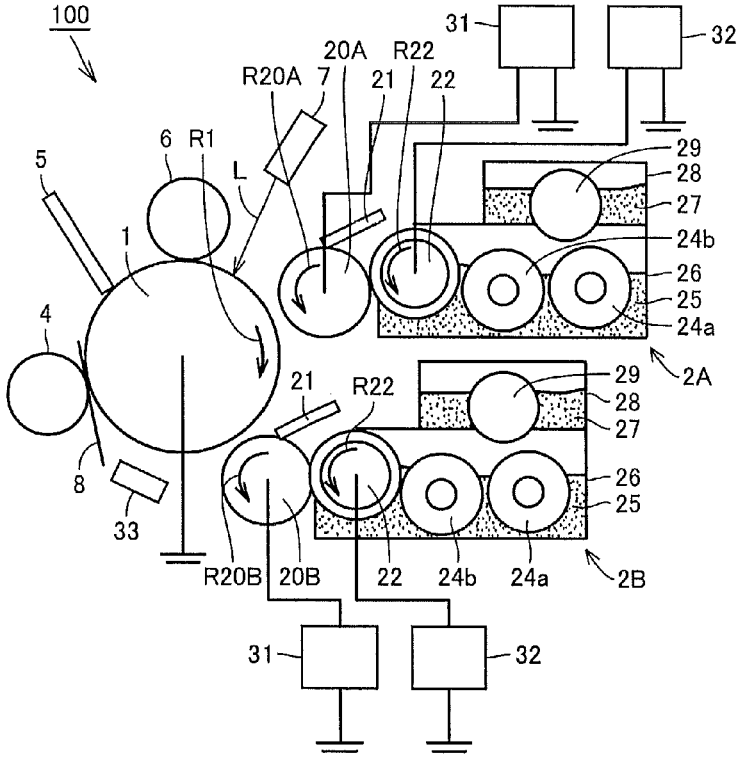
FIG. 2 is a cross sectional view schematically showing an image forming unit including a developer device according to the first embodiment.

FIG. 2 is a cross sectional view schematically showing details of image forming unit 100. Image forming unit 100 includes a developer device 2A (first developer device) and a developer device 2B (second developer device) according to the present embodiment. The structure of image forming unit 100 will be described below.

The single component development system is adopted in image forming unit 100 as a development system. Image forming unit 100 can be incorporated into an image forming apparatus of an electrophotographic system, such as a copying machine, a printer or a facsimile (e.g., image forming apparatus 1000 in FIG. 1).

Image forming unit 100 includes an image carrier 1, a transfer unit 4, a cleaning unit 5, a charging unit 6, an exposing unit 7, developer device 2A, developer device 2B, and an image density sensing unit 33. Transfer unit 4, cleaning unit 5, charging unit 6, exposing unit 7, developer device 2A, developer device 2B, and image density sensing unit 33 are arranged in the order presented around image carrier 1 along the rotating direction of image carrier 1 (direction of an arrow R1). The operation of image forming unit 100 will be described below.

Image carrier 1 as a photoconductor is rotated in the direction of arrow R1. The surface of image carrier 1 is uniformly charged by charging unit 6 with the rotation of image carrier 1. A surface potential (Vo) is applied to image carrier 1. Exposing unit 7 receives an image signal from a digital image processing unit (not shown) to modulate laser, and irradiates the surface of image carrier 1 with laser L having been modulated. The surface of image carrier 1 is exposed by the irradiation of laser L, and an electrostatic latent image (not shown) is formed on the surface of image carrier 1.

The development system in each of developer devices 2A and 2B is the single component development system. Developer devices 2A and 2B transport a developer 25 (toner) to the electrostatic latent image formed on the surface of image carrier 1. The electrostatic latent image is developed (visualized) as a toner image by developer 25.

A developer roller 20A (first developer carrier) in developer device 2A is opposed to image carrier 1 at a predetermined spacing (gap). A developer roller 20B (second developer carrier) in developer device 2B is also opposed to image carrier 1 at a predetermined spacing. Developer roller 20B is located downstream from developer roller 20A in the rotating direction of image carrier 1 (direction of arrow R1).

Developer devices 2A and 2B have generally similar structures. As to the structure and operation in developer devices 2A and 2B as to than respective developer rollers 20A and 2013, description will be given representatively based on developer device 2A. As to developer device 2B, repeated description will not be provided.

In developer device 2A, supply toner 27 in a toner supply unit 28 is transported to a mixing stirrer tank 26 by means of a supply toner transport member 29. Supply toner 27 is mixed with developer 25 in mixing stirrer tank 26, and then transported to a developer transport roller 22 by means of developer transport members 24*a* and 24*b*. Developer 25 and supply toner 27 (hereinafter generically simply called developer 25) are both single component developers in the form of powder made of toner.

The toner may be negatively charged or may be positively charged. The toner is charged by friction with a developer layer regulating member 21. The toner can be manufactured by using a common method (a grinding method, an emulsion polymerization method, a suspension polymerization method, or the like).

A predetermined voltage is applied by a voltage applying unit 31 to developer roller 20A rotated in the direction of an arrow R20A (developer roller 20B rotated in the direction of an arrow R20B). A predetermined voltage is applied by a voltage applying unit 32 to developer transport roller 22 rotated in the direction of an arrow R22. By the application of these voltages, developer 25 is transported from developer transport roller 22 to developer roller 20A. The amount (layer thickness) of developer 25 transported onto developer roller 20A is adjusted by developer layer regulating member 21.

A developer bias (developer bias voltage) obtained by superimposing an AC voltage on a DC voltage is applied by voltage applying unit 31 to developer roller 20A to which developer 25 has been transported. By the application of an optimized developer bias, developer 25 is scattered from developer roller 20A to image carrier 1. Developer 25 is transported onto an electrostatic latent image formed on image carrier 1 by the irradiation of laser L. The electrostatic latent image is developed (visualized) as a toner image by the adhesion of developer 25.

The toner image formed on the surface of image carrier 1 is transferred to recording medium 8 by transfer unit 4. Developer 25 transferred to recording medium 8 is provided with heat, pressure and the like by a fixing device (not shown) or the like, and then fixed onto recording medium 8.

Having passed by transfer unit 4 by the rotation of image carrier 1, the toner image formed on the surface of image carrier 1 is removed from image carrier 1 by cleaning unit 5 such as a cleaning blade. The surface of image carrier 1 from which the toner image has been removed is transported again to charging unit 6 to be subjected to development of another toner image.

The image density of visualized developer 25 on recording medium 8 may be sensed by image density sensing unit 33. In this case, an image forming condition is set up depending on the sensed image density. It may be constructed such that the output voltage of voltage applying unit 31 is controlled based on this image forming condition.

The above operation is repeated in developer devices 2A and 2B. In image forming unit 100, developer rollers 20A and 20B are arranged opposite to one image carrier 1. Image forming unit 100 can ensure a longer developing time than in the case where one developer roller is arranged opposite to one image carrier (photoconductor). Also in high-speed printing, for example, image carrier 1 and developer rollers 20A, 20B are opposed to each other for a longer time. A sufficient amount of toner can be transported to image carrier 1.

Image forming unit 100 is constructed such that a toner image is directly transferred from image carrier 1 to recording medium 8. Another construction may be such that a toner image is once transferred to an intermediate transfer member (not shown), on which another color is superimposed, and then the toner image is transferred to recording medium 8.

Experimental Examples

In image forming unit 100 described above, the developer bias for scattering developer 25 is optimized. Experimental examples (including examples and comparative examples) carried out to obtain this optimization will be described below.

Setup Conditions

The following are respective setup conditions in the experimental examples. The system speed of image forming unit 100 was set at about 300 mm/s. Metalumy (registered trademark) (available from Toray Industries, Inc.) made of an aluminum-deposited PET film having a thickness of about 30 μm was used for image carrier 1 (see FIG. 2) instead of the photoconductor of the above-described first embodiment.

An electrostatic latent image was formed on the surface of image carrier 1 by water charging. In water charging, water dropped on the surface of image carrier 1 and the tooth of a cutter are brought into contact. A voltage is applied in this state. By applying a surface potential (Vi) in accordance with the applied voltage to the surface of image carrier 1, an electrostatic latent image is formed on the surface of image carrier 1. Surface potential Vi at the electrostatic latent image is about −350V to 0V.

For developer rollers 20A and 20B, an aluminum roller having an anodized surface was used. The distance between each of developer rollers 20A, 20B and image carrier 1 was set at about 250 μm at the closest position. The amount of developer 25 transported on developer rollers 20A and 20B was set at about 6 g/m$^2$.

Under the respective setup conditions as described above, various combinations of five types of developer biases were applied to developer rollers 20A and 20B as developer biases for scattering developer 25 from developer rollers 20A and 20B to image carrier 1 (details of these combinations will be described later).

Figure 3:
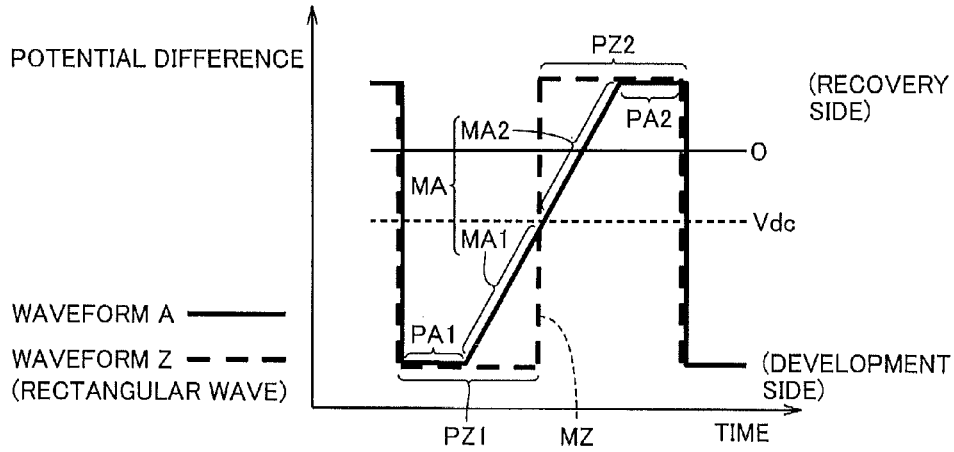
FIG. 3 is a first diagram showing waveforms of voltages (potential differences) applied as developer biases in the developer device according to experimental examples of the first and second embodiments.
Figure 4:
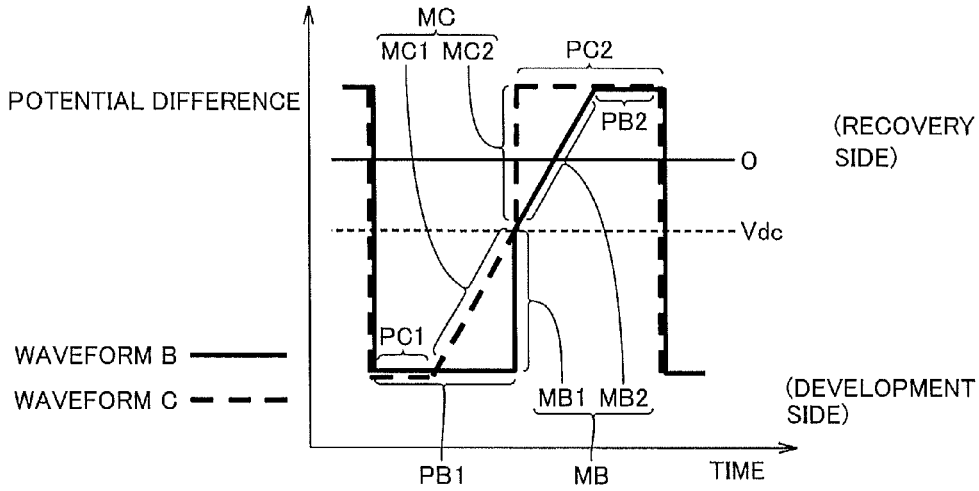
FIG. 4 is a second diagram showing waveforms of voltages (potential differences) applied as developer biases in the developer device according to experimental examples of the first and second embodiments.
Figure 5:
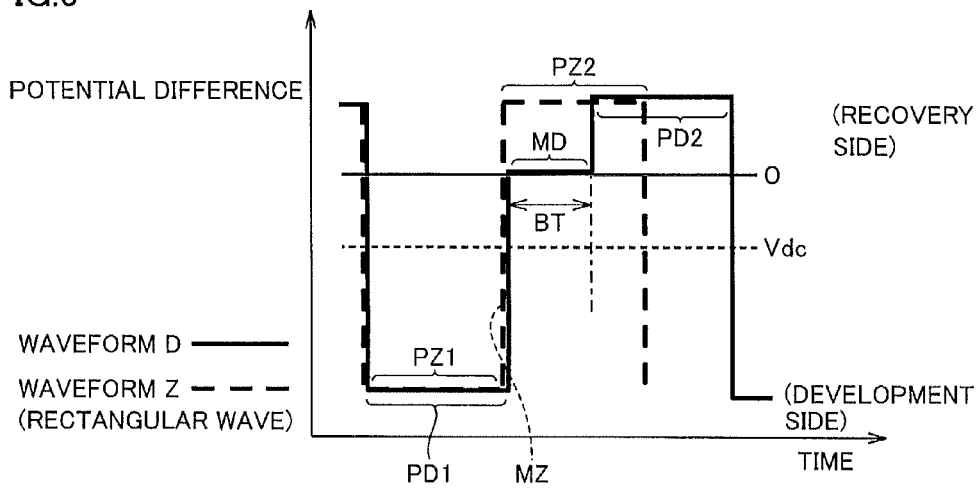
FIG. 5 is a third diagram showing waveforms of voltages (potential differences) applied as developer biases in the developer device according to experimental examples of the first and second embodiments.

Referring to FIGS. 3 to 5, waveforms Z and A to D were prepared for five types of developer biases. The potential difference plotted on the vertical axis in the respective drawings represents a relative potential difference of each of developer rollers 20A and 20B with respect to image carrier 1 assuming that image carrier 1 is grounded. Details of waveforms Z and A to D will be described below sequentially.

Waveform Z: Rectangular Wave

Referring to FIG. 3, waveform Z indicated by the broken line in the drawing is a typical rectangular wave. Waveform Z periodically includes a development-side peak section PZ1 where the developer is biased from the developer roller toward the image carrier, a recovery-side peak section PZ2 where the developer is biased from the image carrier toward the developer roller, and a voltage changing section MZ which is a transition from development-side peak section PZ1 to recovery-side peak section PZ2.

The developer bias indicated by waveform Z has a DC component Vdc of −350V, an amplitude (Peak to Peak) of 2250V, a duty ratio (a ratio between the operating time of a development-side voltage at which the developer is supplied to the image carrier and the operating time of a recovery-side voltage at which the developer is returned to the developer roller) of 50%, and a frequency of 5 kHz. The potential difference in development-side peak section PZ1 is −1475V, and the potential difference in recovery-side peak section PZ2 is 775V.

In voltage changing section MZ, the potential difference changes vertically from development-side peak section PZ1 to recovery-side peak section PZ2. Waveform Z in voltage changing section MZ rises up vertically, and the operating time of developer bias in voltage changing section MZ is substantially 0 second.

Waveform A

Still referring to FIG. 3, waveform A indicated by the solid line in the drawing is obtained by deforming a typical rectangular wave (waveform Z) as described above. Waveform A periodically includes a development-side peak section PA1 where the developer is biased from the developer roller toward the image carrier, a recovery-side peak section PA2 where the developer is biased from the image carrier toward the developer roller, and a voltage changing section MA which is a transition from development-side peak section PA1 to recovery-side peak section PA2.

The operating time of developer bias at the frequency of 5 kHz (one cycle) is about 30% in development-side peak section PA1, about 30% in recovery-side peak section PA2, and about 40% in voltage changing section MA.

In voltage changing section MA, the potential difference changes obliquely from development-side peak section PA1 to recovery-side peak section PA2. Waveform A in voltage changing section MA is inclined such that the potential difference increases gradually (in the positive direction) both in a first half MA1 (rising edge) of voltage changing section MA and a second half MA2 of voltage changing section MA. The remaining properties (the amplitude, the potential difference in the development-side peak section, the potential difference in the recovery-side peak section, etc.) are similar to those of waveform Z.

Waveform B

Referring to FIG. 4, waveform B indicated by the solid line in the drawing is also obtained by deforming a typical rectangular wave (waveform Z) as described above. Waveform B periodically includes a development-side peak section PB1 where the developer is biased from the developer roller toward the image carrier, a recovery-side peak section PB2 where the developer is biased from the image carrier toward the developer roller, and a voltage changing section MB which is a transition from development-side peak section PB1 to recovery-side peak section PB2.

The operating time of developer bias at the frequency of 5 kHz (one cycle) is about 50% in development-side peak section PB1, about 30% in recovery-side peak section PB2, and about 20% in voltage changing section MB.

In voltage changing section MB, starting from development-side peak section PB1, the potential difference changes vertically from that starting point to a potential difference equivalent to DC component Vdc. Waveform B in voltage changing section MB rises up vertically in a first half MB1 (rising edge) of voltage changing section MB (the operating time is substantially 0 second) and is inclined such that the potential difference increases gradually (in the positive direction) only in a second half MB2 of voltage changing section MB. The remaining properties are generally similar to those of waveform Z.

Waveform C

Still referring to FIG. 4, waveform C indicated by the solid line in the drawing is also obtained by deforming a typical rectangular wave (waveform Z) as described above. Waveform C periodically includes a development-side peak section PC1 where the developer is biased from the developer roller toward the image carrier, a recovery-side peak section PC2 where the developer is biased from the image carrier toward the developer roller, and a voltage changing section MC which is a transition from development-side peak section PC1 to recovery-side peak section PC2.

The operating time of developer bias at the frequency of 5 kHz (one cycle) is about 30% in development-side peak section PC1, about 50% in recovery-side peak section PC2, and about 20% in voltage changing section MC.

In voltage changing section MC, starting from the potential difference equivalent to DC component Vdc, the potential difference changes vertically from that starting point to recovery-side peak section PC2. Waveform C in voltage changing section MC is inclined such that the potential difference increases gradually (in the positive direction) in a first half MC1 (rising edge) of voltage changing section MC and rises up vertically in a second half MC2 of voltage changing section MC (the operating time is substantially 0). The remaining properties are generally similar to those of waveform Z.

Waveform D

Referring to FIG. 5, waveform D indicated by the solid line in the drawing is also obtained by deforming a typical rectangular wave (waveform Z) as described above. It is noted that waveform Z is also shown in FIG. 5 for ease of description. Waveform D periodically includes a development-side peak section PD1 where the developer is biased from the developer roller toward the image carrier, a recovery-side peak section PD2 where the developer is biased from the image carrier toward the developer roller, and a voltage changing section MD which is a transition from development-side peak section PD1 to recovery-side peak section PD2.

The operating time of developer bias in development-side peak section PD1 of waveform D is equal to the operating time of developer bias in development-side peak section PZ1 of waveform Z. The operating time of developer bias in recovery-side peak section PD2 of waveform D is equal to the operating time of developer bias in recovery-side peak section PZ2 of waveform Z.

Waveform D in voltage changing section MD is a blank pulse (potential difference: about 0V) having a blank pulse time BT of more than or equal to about 0.02 ms and less than or equal to about 0.08 ms. The remaining properties are generally similar to those of waveform Z. The range of blank pulse time BT will be described later in detail.

Relationship 1 Between Image Potential and Image Density

Figure 6:
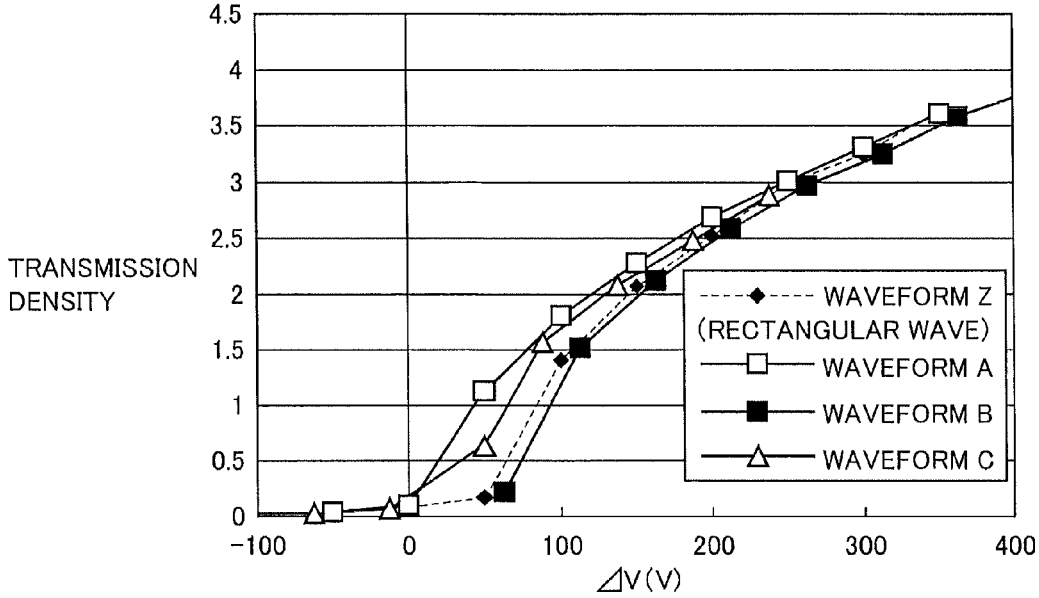
FIG. 6 is a first diagram showing the results of measurements of experimental examples performed using the developer device according to the first embodiment.

Referring to FIG. 6, the following experiment was conducted under the above-described setup conditions. The developer bias of waveform Z (rectangular wave) was applied to developer roller 20A. The developer bias of any of waveforms Z and A to C was applied to developer roller 20B. In that experiment, the relationship between an image potential ΔV (|DC component Vdc−surface potential Vi|) and the image density in a resultant image was measured. In this measurement, "310TR" available from X-RIte, Inc. was used to measure the transmission density.

FIG. 6 shows the results of measurements in that experiment for waveforms Z and A to C of the developer biases applied to developer roller 20B. The lines denoted by waveforms Z and A to C show the results of measurements in that experiment when developer biases of waveforms Z and A to C were applied to developer roller 20B.

From the results of measurements described above, the following holds true at a low-density potential (e.g., about 50V to about 100V). A higher image density (transmission density) can be obtained in the case of applying a developer bias based on waveform A or C to developer roller 20B than in the case of applying a developer bias based on waveform Z or B to developer roller 20B.

Relationship 2 Between Image Potential and Image Density

Figure 7:
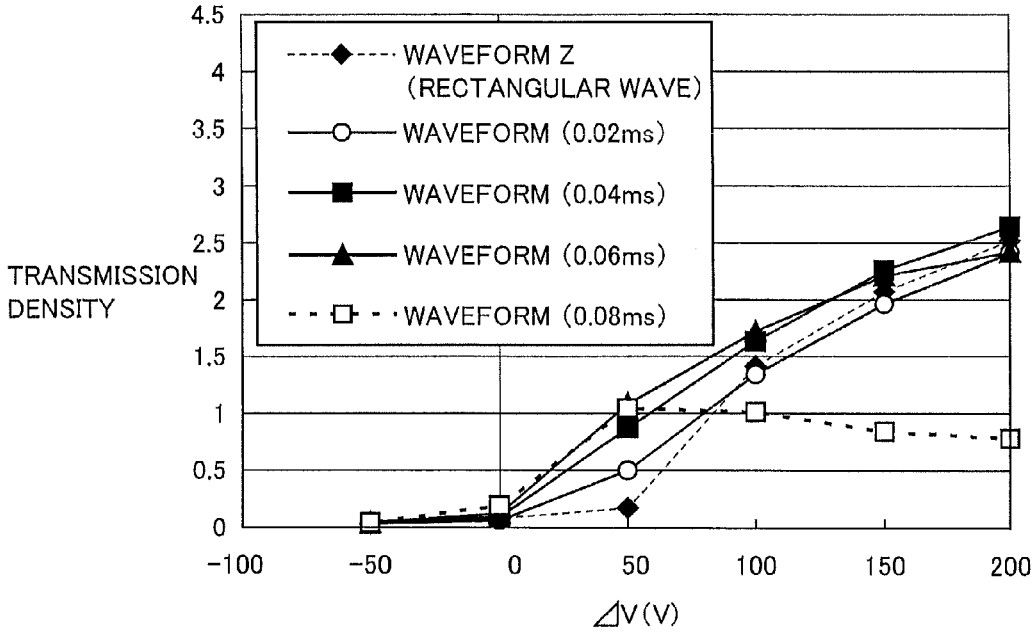
FIG. 7 is a second diagram showing the results of measurements of experimental examples performed using the developer device according to the first embodiment.

Referring to FIG. 7, another experiment below was conducted under the above-described setup conditions. The developer bias of waveform Z (rectangular wave) was applied to developer roller 20A. The developer bias of each of waveform Z and four types of waveforms D different in blank pulse time BT was applied to developer roller 20B. In that experiment, the relationship between image potential ΔV (|DC component Vdc−surface potential Vi|) and the transmission density in a resultant image was also measured.

FIG. 7 shows the results of measurements in that experiment for a waveform (0.02 ms), a waveform (0.04 ms), a waveform (0.06 ms), and a waveform (0.08 ms) of the developer biases based on waveforms D applied to developer roller 20B. The line denoted by waveform Z shows the results of measurements in that experiment when a developer bias of waveform Z was applied to developer roller 20B (equal to the line denoted by waveform Z in FIG. 6).

In FIG. 7, the line denoted by the waveform (0.02 ms), the waveform (0.04 ms), the waveform (0.06 ms), and the waveform (0.08 ms) show the results of measurements in that experiment when the developer bias of waveform D was applied to developer roller 20B setting blank pulse time BT (see FIG. 5) at 0.02 ms, 0.04 ms, 0.06 ms, and about 0.08 ms, respectively.

From the results of measurements described above, the following holds true at a low-density potential (e.g., about 50V to about 100V). A higher image density (transmission density) can be obtained at a low-density potential in the case of applying to developer roller 20B a developer bias based on waveform D having blank pulse time BT of more than or equal to about 0.02 ms and less than or equal to about 0.08 ins than in the case of applying a developer bias based on waveform Z to developer roller 20B. However, it has been found out that other measures need to be taken since a very high image density cannot be obtained at a high-density potential in the case of applying to developer roller 20B a developer bias based on waveform D having blank pulse time BT of more than or equal to 0.08 ms. It is therefore desirable to set blank pulse time BT at more than or equal to about 0.02 ms and less than or equal to about 0.06 ms.

Comparative Examples and Examples

FIG. 8 collectively shows the results of measurements described above and the results of experiments further conducted based on the results of measurements described above as Comparative Examples 1 to 7 and Examples 1 to 6. In Comparative Examples 1 to 7 and Examples 1 to 6, developer biases of various combinations of waveforms Z and A to D were applied to developer rollers 20A and 20B under setup conditions similar to those described above. It is noted that, as to waveform D, the results when blank pulse time BT (see FIG. 5) was 0.02 ms, 0.04 ms, 0.06 ms, and 0.08 ms were the same, and are thus shown collectively.

FIG. 8 shows whether or not a desired image density was obtained at a low-density potential. The state where the image density is high is denoted by a symbol Y, and the state where the image density is low is denoted by a symbol X.

The state where the image density is high refers to the state where the desired image density was obtained. Here, this state is defined as the case where the image density at image potential ΔV=50V is more than or equal to 0.4. The state where the image density is low refers to the state where the desired image density was not obtained. Here, this state is defined as the case where the image density at image potential ΔV=50V is less than 0.4.

FIG. 8 also shows the presence/absence of change in image density (image stability) with respect to a Ds variation (change in distance at the closest position between the developer roller and the image carrier). The state where the image stability was obtained is denoted by symbol Y, and the state where the image stability was not obtained is denoted by symbol X.

The state where the image stability was obtained refers to the state where there is no change in image density with respect to the Ds variation. Here, this state is defined as the case where the difference in transmission density at image potential ΔV=150V is less than 0.6 with development characteristics where Ds=about 220 μm and Ds=about 280 μm. The state where the image stability was not obtained refers to the state where there is a change in image density with respect to the Ds variation. Here, this state is defined as the case where the difference in transmission density at image potential ΔV=150V is more than or equal to 0.6 with development characteristics where Ds=about 220 μm and Ds=about 280 μm.

As shown in FIG. 8, the following developer biases were applied to developer rollers 20A and 20B in Comparative Examples 1 to 7 and Examples 1 to 6.

In Comparative Example 1, waveform Z was applied to developer roller 20A, and waveform Z was applied to developer roller 20B. In Comparative Example 2, waveform A was applied to developer roller 20A, and waveform A was applied to developer roller 20B. In Comparative Example 3, waveform B was applied to developer roller 20A, and waveform B was applied to developer roller 20B. In Comparative Example 4, waveform C was applied to developer roller 20A, and waveform C was applied to developer roller 20B. In Comparative Example 5, waveform D was applied to developer roller 20A, and waveform D was applied to developer roller 20B. In Comparative Example 6, waveform B was applied to developer roller 20A, and waveform Z was applied to developer roller 20B. In Comparative Example 7, waveform Z was applied to developer roller 20A, and waveform B was applied to developer roller 20B.

In Example 1, waveform A was applied to developer roller 20A, and waveform Z was applied to developer roller 20B. In Example 2, waveform Z was applied to developer roller 20A, and waveform A was applied to developer roller 20B. In Example 3, waveform C was applied to developer roller 20A, and waveform Z was applied to developer roller 20B. In Example 4, waveform Z was applied to developer roller 20A, and waveform C was applied to developer roller 20B. In Example 5, waveform D was applied to developer roller 20A, and waveform Z was applied to developer roller 20B. In Example 6, waveform Z was applied to developer roller 20A, and waveform D was applied to developer roller 20B.

As shown in the results of evaluations in FIG. 8, in Comparative Examples 2, 4 and 5, the image stability with respect to the Ds variation could not be obtained (symbol X), although the image density at a low-density potential could be obtained (symbol Y). In Comparative Examples 1, 6 and 7, the image density at a low-density potential could not be obtained (symbol X), although the image stability with respect to the Ds variation could be obtained (symbol Y). In Comparative Example 3, the image density at a low-density potential could not be obtained (symbol X), and the development stability with respect to the Ds variation could not be obtained (symbol X).

On the other hand, in Examples 1 to 6, the image density at a low-density potential could be obtained (symbol Y), and the development stability with respect to the Ds variation could also be obtained (symbol Y).

Consequently, it can be understood that a developer bias of waveform Z (rectangular wave) may be applied to developer roller 20A and a developer bias of waveform A, C or D may be applied to developer roller 20B. It can also be understood that waveform Z (rectangular wave) may be applied to developer roller 20B and waveform A, C or D may be applied to developer roller 20A. In other words, waveform Z may be applied to one of developer rollers 20A and 20B and waveform A, C or D may be applied to the other of developer rollers 20A and 20B.

The reason for this is supposed to be as described below. More specifically, waveform A (see FIG. 3) is inclined in first half MA1 of voltage changing section MA such that the potential difference increases gradually (in the positive direction) from development-side peak section PA1 to recovery-side peak section PA2. Waveform C (see FIG. 4) is also inclined in first half MC1 of voltage changing section MC such that the potential difference increases gradually (in the positive direction) from development-side peak section PC1 to recovery-side peak section PC2 (a potential difference equivalent to DC component Vdc).

Waveforms A and C are inclined such that the potential difference increases gradually (in the positive direction) from the leading edge of development-side peak sections PA1 and PC1, respectively. The amount of the developer transported from the developer roller to the image carrier decreases gradually. It is therefore supposed that the developer (toner) adhered to the image carrier 1 side (on an electrostatic latent image) is prevented from being dislodged by the developer being subsequently scattered toward the image carrier (electrostatic latent image) (from being returned to the developer roller side from the image carrier) (hereinafter referred to as a dislodged phenomenon).

Waveform D (see FIG. 5) has voltage changing section MD with blank pulse time BT between development-side peak section PD1 and recovery-side peak section PD2. It is supposed that in this voltage changing section MD, a time period for which the developer is reduced in speed is ensured by the absence of electric field that would act on a scattered developer, and the dislodged phenomenon is prevented similarly to the case of waveform A or C.

In contrast to these, waveform Z (see FIG. 3) is a rectangular wave, and in voltage changing section MZ, the potential difference rises up vertically from development-side peak section PZ1 to recovery-side peak section PZ2. In other words, in waveform Z, the potential difference changes rapidly from development-side peak section PZ1 to recovery-side peak section PZ2. In waveform B (see FIG. 4), the potential difference also rises up vertically in first half MB1 of voltage changing section MB from development-side peak section PB1 to recovery-side peak section PB2 (a potential difference equivalent to DC component Vdc). In other words, in waveform B, the potential difference also changes rapidly from development-side peak section PB1 to recovery-side peak section PB2 (a potential difference equivalent to that of DC component Vdc).

In waveforms Z and B, the potential difference changes to increase rapidly (in the positive direction) from the leading edge of development-side peak sections PZ1 and PB1, respectively. The amount of the developer transported from the developer roller to the image carrier decreases rapidly. This is supposed to be the reason why the dislodged phenomenon occurs.

It is noted that applying waveform Z (rectangular wave) to developer roller 20A and waveform A, C or D to developer roller 20B is considered as being a more desirable form since the dislodged phenomenon at developer roller 20B in the latter stage is prevented. In the case of applying waveform Z (rectangular wave) to developer roller 20B and waveform A, C or D to developer roller 20A, the dislodged phenomenon at developer roller 20A in the previous stage is prevented, however, the dislodged phenomenon exists at developer roller 20B in the latter stage. Therefore, a sufficient amount of developer needs to be adhered to image carrier 1 by developer roller 20A in the previous stage.

In addition, from the results of experiments, when waveform Z is applied to at least one of developer roller 20A and developer roller 20B, the image stability with respect to the Ds variation is obtained. The reason is supposed to be that the sensitivity to the Ds variation, namely, a change in distance, increases since the speed of a developer being scattered is reduced in a certain portion of any of waveforms A to D. It is therefore desirable to apply waveform Z (rectangular wave) to one of developer roller 20A and developer roller 20B.

Therefore, as described above, according to image forming unit 100 including developer devices 2A and 2B, by applying waveform Z to one of developer rollers 20A and 20B and applying waveform A or C to the other of developer rollers 20A and 20B, a high image density can be obtained even at a low-density potential, and besides, a change in image density (occurrence of variations, unevenness, etc.) can be prevented even if the Ds variation occurs. Similar effects can also be obtained in an image forming apparatus including such image forming unit 100.

Second Embodiment

Hybrid Development System

Figure 9:
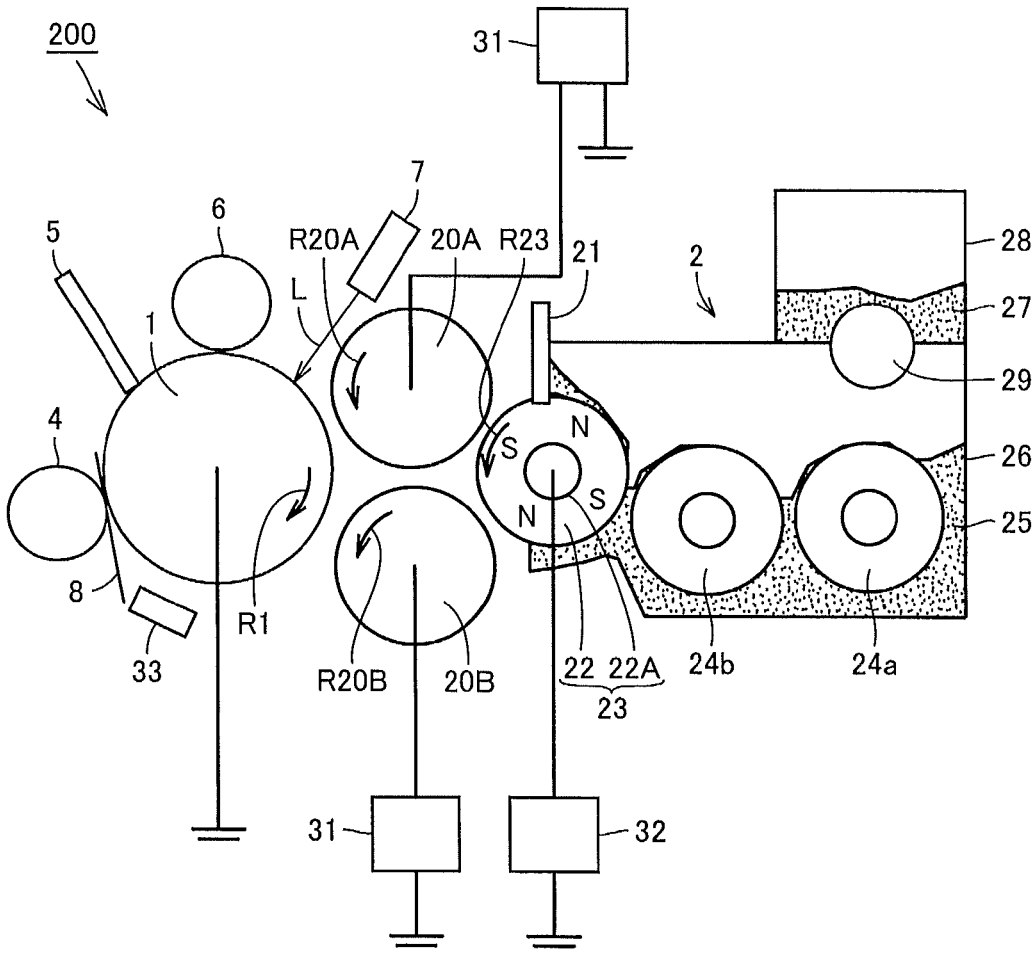
FIG. 9 is a cross sectional view schematically showing an image forming unit including the developer device according to the second embodiment.

FIG. 9 is a cross sectional view schematically showing an image forming unit 200. Image forming unit 200 includes a developer device 2 according to the present embodiment. The structure of image forming unit 200 will be described below.

The hybrid development system is adopted in image forming unit 200 as a development system. Image forming unit 200 can be incorporated into an image forming apparatus of an electrophotographic system, such as a copying machine, a printer, or a facsimile (e.g., image forming apparatus 1000 in FIG. 1).

Image forming unit 200 includes image carrier 1, transfer unit 4, cleaning unit 5, charging unit 6, exposing unit 7, developer device 2, and image density sensing unit 33. Transfer unit 4, cleaning unit 5, charging unit 6, exposing unit 7, developer device 2, and image density sensing unit 33 are arranged in the order presented around image carrier 1 along the rotating direction of image carrier 1 (direction of arrow R1). The operation of image forming unit 200 will be described below.

Image carrier 1 as a photoconductor is rotated in the direction of arrow R1. The surface of image carrier 1 is uniformly charged by charging unit 6 with the rotation of image carrier 1. A surface potential (Vo) is applied to image carrier 1. Exposing unit 7 receives an image signal from a digital image processing unit (not shown) to modulate laser, and irradiates the surface of image carrier 1 with laser L having been modulated. The surface of image carrier 1 is exposed by the irradiation of laser L, and an electrostatic latent image (not shown) is formed on the surface of image carrier 1.

The hybrid development system is adopted in image forming unit 200 as a development system, and developer 25 containing toner and a carrier is used. The electrostatic latent image is developed (visualized) as a toner image by the toner in developer 25.

Developer roller 20A (first developer carrier) in developer device 2 is opposed to image carrier 1 at a predetermined spacing (gap). Developer roller 20B (second developer carrier) in developer device 2 is also opposed to image carrier 1 at a predetermined spacing. Developer roller 20B is located downstream from developer roller 20A in the rotating direction of image carrier 1 (direction of arrow R1).

In developer device 2, supply toner 27 in toner supply unit 28 is transported to mixing stirrer tank 26 by means of supply toner transport member 29. Supply toner 27 is mixed with developer 25 containing the carrier in mixing stirrer tank 26 by means of developer transport members 24*a* and 24*b*.

The toner may be negatively charged or positively charged by friction with the carrier. The toner can be manufactured by using a common method (a grinding method, an emulsion polymerization method, a suspension polymerization method, or the like).

As the carrier, one having magnetism is adopted, and a binder-type carrier or a coat-type carrier can be used. The carrier may have a particle diameter ranging from about 15 μm to about 100 μm. The ratio of the toner in the developer preferably ranges from about 5 weight % to about 30 weight %, and about 8 weight % is more preferable.

The toner in developer 25 is triboelectrically charged by mixture with the carrier. Developer 25 is transported by means of a magnet roller 23 (transport member) using the magnetism of the carrier. Magnet roller 23 has a developer transport roller (sleeve) 22 and a magnetic substance 22A provided in developer transport roller 22 and having a plurality of magnetic poles. The amount (layer thickness) of developer 25 transported onto magnet roller 23 is adjusted by developer layer regulating member 21.

A predetermined voltage is applied to magnet roller 23 transporting developer 25 in the direction of an arrow R23 by voltage applying unit 32 connected thereto. A predetermined voltage is applied to developer roller 20A rotated in the direction of arrow R20A by voltage applying unit 31 connected thereto. A predetermined voltage is, also applied to developer roller 20B rotated in the direction of arrow R20B by voltage applying unit 31 connected thereto.

By the application of these voltages, only the toner in developer 25 on magnet roller 23 is supplied to developer rollers 20A and 20B. A developer bias obtained by superimposing an AC voltage on a DC voltage is applied by voltage applying unit 31 to developer rollers 20A and 20B to which developer 25 has been supplied. By the application of an optimized developer bias, the toner is scattered from developer rollers 20A and 20B to image carrier 1. The toner is adhered to an electrostatic latent image formed on image carrier 1 by the irradiation of laser L. The electrostatic latent image is developed (visualized) as a toner image by the adhesion of the toner.

Having passed by transfer unit 4 by the rotation of image carrier 1, the toner image formed on the surface of image carrier 1 is removed from image carrier 1 by cleaning unit 5 such as a cleaning blade. The surface of image carrier 1 from which the toner image has been removed is transported again to charging unit 6 to be subjected to development of another toner image.

The image density of visualized developer 25 on recording medium 8 may be sensed by image density sensing unit 33. In this case, an image forming condition is set up depending on the sensed image density. It may be constructed such that the output voltage of voltage applying unit 31 is controlled based on this image forming condition.

The above operation is repeated in developer device 2. In image forming unit 200, developer rollers 20A and 20B are arranged opposite to one image carrier 1. Image forming unit 200 can ensure a longer developing zone than in the case where one developer roller is arranged opposite to one image carrier (photoconductor). Also in high-speed printing, for example, image carrier 1 and developer rollers 20A, 20B are opposed to each other for a longer time. A sufficient amount of toner can be transported to image carrier 1.

Image forming unit 200 is constructed such that a toner image is directly transferred from image carrier 1 to recording medium 8. Another construction may be such that a toner image is once transferred to an intermediate transfer member (not shown), on which another color is superimposed, and then the toner image is transferred to recording medium 8.

Experimental Examples

In image forming unit 200 described above, the developer bias for scattering the toner is optimized. Experimental examples (including examples and comparative examples) carried out to obtain this optimization will be described below. Respective setup conditions in the experimental examples are generally similar to the respective setup conditions in the experimental examples of the above-described first embodiment.

Under the setup conditions, various combinations of five types of developer biases similar to those in the experimental examples of the above-described first embodiment were applied to developer rollers 20A and 20B as developer biases for scattering the toner from developer rollers 20A and 20B to image carrier 1 (details of these combinations will be described later).

Comparative Examples and Examples

Referring to FIG. 10, Comparative Examples 1A to 3A and Examples 1A to 6A will be described. In Comparative Examples 1A to 3A and Examples 1A to 6A, various combinations of developer biases of waveforms Z and A to D (see FIGS. 3 to 5) shall be applied to developer rollers 20A and 20B.

FIG. 10 shows whether or not a desired image density was obtained at a low-density potential. The state where the image density is high is denoted by symbol Y, and the state where the image density is low is denoted by symbol X. It is noted that the definitions of symbol Y and symbol X indicating the states of image density are similar to those in the above-described first embodiment.

FIG. 10 also shows the presence/absence of change in image density (image stability) with respect to the Ds variation (change in distance at the closest position between the developer roller and the image carrier). The state where the image stability was obtained is denoted by symbol Y in the drawing, and the state where the image stability was not obtained is denoted by symbol X in the drawing. It is noted that the definitions of symbol Y and symbol X indicating the states of image stability are similar to those in the above-described first embodiment.

As shown in FIG. 10, the following developer biases were applied to developer rollers 20A and 20B in Comparative Examples 1A to 3A and Examples 1A to 6A.

In Comparative Example 1A, waveform A was applied to developer roller 20A, and waveform A was applied to developer roller 20B. In Comparative Example 2A, waveform C was applied to developer roller 20A, and waveform C was applied to developer roller 20B. In Comparative Example 3A, waveform D was applied to developer roller 20A, and waveform D was applied to developer roller 20B.

In Example 1A, waveform A was applied to developer roller 20A, and waveform Z was applied to developer roller 20B. In Example 2A, waveform Z was applied to developer roller 20A, and waveform A was applied to developer roller 20B. In Example 3A, waveform C was applied to developer roller 20A, and waveform Z was applied to developer roller 20B. In Example 4A, waveform Z was applied to developer roller 20A, and waveform C was applied to developer roller 20B. In Example 5A, waveform D was applied to developer roller 20A, and waveform Z was applied to developer roller 20B. In Example 6A, waveform Z was applied to developer roller 20A, and waveform D was applied to developer roller 20B.

As shown in the results of evaluations in FIG. 10, in Comparative Examples 1A to 3A, the image stability with respect to the Ds variation could not be obtained (symbol X), although the image density at a low-density potential could be obtained (symbol Y). On the other hand, in Examples 1A to 6A, the image density at a low-density potential could be obtained (symbol Y), and the development stability with respect to the Ds variation could also be obtained (symbol Y).

Consequently, it can be understood that a developer bias of waveform Z (rectangular wave) may be applied to developer roller 20A and a developer bias of waveform A, C or D may be applied to developer roller 20B. It can also be understood that a developer bias of waveform Z (rectangular wave) may be applied to developer roller 20B and a developer bias of waveform A, C or D may be applied to developer roller 20A. In other words, a developer bias of waveform Z may be applied to one of developer rollers 20A and 20B and a developer bias of waveform A, C or D may be applied to the other of developer rollers 20A and 20B.

The reason for this is supposed to be similar to that in the image forming apparatus of the single component development system according to the above-described first embodiment.

It is noted that, in image forming unit 100 according to the above-described first embodiment, a comparison between the results of evaluations in initial printing and the results of evaluations after printing 3000 sheets has revealed that a slight reduction in image density at a low-density potential was found after the 3000-sheet printing. This is supposed to be caused by degradation of the toner by the single component development system. On the other hand, in image forming unit 200 according to the second embodiment, no reduction in image density at a low-density potential occurred even after the 3000-sheet printing. It can be said from this that image forming unit 200 adopting the hybrid development system can perform favorable development over a longer period of time than image forming unit 100 adopting the single component development system.

Although the embodiments of the present invention have been described above, it should be understood that the embodiments disclosed herein are illustrative and non-restrictive in every respect. The scope of the present invention is defined by the claims, and is intended to include any modification within the meaning and scope equivalent to the terms of the claims.

REFERENCE SIGNS LIST

1 image carrier; 2, 2A, 2B developer device; 4 transfer unit; 5 cleaning unit; 6 charging unit; 7 exposing unit; 8 recording medium; 20A, 20B developer roller; 21 developer layer regulating member; 22 developer transport roller; 22A magnetic substance roller; 23 magnet roller; 24*a*, 24*b* developer transport member; 25 developer; 26 mixing stirrer tank; 27 supply toner; 28 toner supply unit; 29 supply toner transport member; 31, 32 voltage applying unit; 33 image density sensing unit; 50 operation panel; 51 control unit; 51*a* key; 52 operation display; 53 scanner; 54 printer; 55 feeder; 57 tray; 58 paper feed unit; 100, 200 image forming unit; 1000 image forming apparatus; A to D, Z waveform; BT blank pulse time; L laser; MA, MB, MC, MD, MZ voltage changing section; MA1, MB1, MC1 first half; MA2, MB2, MC2 second half; PA1, PB1, PC1, PD1, PZ1 development-side peak section; PA2, PB2, PC2, PD2, PZ2 recovery-side peak section; R1, R20A, R20B, R22, R23 arrow; Vdc DC component; Vi surface potential; X, Y symbol; ΔV image potential.

The invention claimed is:

1. A developer device for developing an electrostatic latent image formed on an image carrier by toner, comprising:

a first developer carrier arranged opposite to said image carrier;

a second developer carrier arranged opposite to said image carrier and located downstream from said first developer carrier in a moving direction of said image carrier;

a first voltage applying unit for applying a first developer bias voltage of a rectangular wave obtained by superimposing an AC voltage on a DC voltage to one of said first developer carrier and said second developer carrier; and a second voltage applying unit for applying a second developer bias voltage obtained by superimposing an AC voltage on a DC voltage to the other of said first developer carrier and said second developer carrier, wherein said AC voltage in said second developer bias voltage has a waveform obtained by deforming the rectangular wave such that toner adhered to said image carrier is prevented from being dislodged by toner being subsequently scattered, the waveform of said AC voltage in said second developer bias voltage has a development-side peak section in which said toner is supplied from one of said first developer carrier and said second developer carrier to said image carrier, a recovery-side peak section in which said toner is returned from said image carrier to one of said first developer carrier and said second developer carrier, and a voltage changing section which is a transition from said development-side peak section to said recovery-side peak section, and said waveform in said voltage changing section is inclined toward said recovery-side peak section starting from a termination of said development-side peak section.

2. The developer device according to claim 1, comprising a transport member arranged opposite to said first developer carrier and said second developer carrier and carrying a developer containing said toner and a carrier and supplying said toner in said developer to said first developer carrier and said second developer carrier.

3. An image forming apparatus comprising:

said image carrier;

an image forming mechanism for forming an electrostatic latent image on said image carrier; and the developer device as defined in claim 1.

4. A developer device for developing an electrostatic latent image formed on an image carrier by toner, comprising:

a first developer carrier arranged opposite to said image carrier;

a second developer carrier arranged opposite to said image carrier and located downstream from said first developer carrier in a moving direction of said image carrier;

a first voltage applying unit for applying a first developer bias voltage of a rectangular wave obtained by superimposing an AC voltage on a DC voltage to one of said first developer carrier and said second developer carrier; and a second voltage applying unit for applying a second developer bias voltage obtained by superimposing an AC voltage on a DC voltage to the other of said first developer carrier and said second developer carrier, wherein said AC voltage in said second developer bias voltage has a waveform obtained by deforming the rectangular wave such that toner adhered to said image carrier is prevented from being dislodged by toner being subsequently scattered, the waveform of said AC voltage in said second developer bias voltage has a development-side peak section in which said toner is supplied from one of said first developer carrier and said second developer carrier to said image carrier, a recovery-side peak section in which said toner is returned from said image carrier to one of said first developer carrier and said second developer carrier (20B), and a voltage changing section which is a transition from said development-side peak section to said recovery-side peak section, and said waveform in said voltage changing section has a blank pulse time having a potential difference of 0.

5. The developer device according to claim 4, wherein said blank pulse time is more than or equal to about 0.02 ms and less than or equal to about 0.06 ms.

* * * * *